United States Patent [19]

Tone et al.

[11] Patent Number: 4,628,686

[45] Date of Patent: Dec. 16, 1986

[54] METHOD AND APPARATUS FOR DOFFING IN A SPINNING FRAME

[75] Inventors: Shoichi Tone, Kyoto; Hiroshi Uchida, Oumihachiman, both of Japan

[73] Assignee: Murata Kikai Kabushiki Kaisha, Kyoto, Japan

[21] Appl. No.: 829,529

[22] Filed: Feb. 14, 1986

[51] Int. Cl.[4] ..... D01H 9/04; D01H 9/14; D01H 1/38; D01H 1/40

[52] U.S. Cl. ..... 57/274; 57/275; 57/276; 57/278; 57/299; 57/305; 242/35.5 A

[58] Field of Search ..... 57/266, 273, 274, 275, 57/276, 278, 299, 300, 303–305; 242/35.5 R, 35.5 A

[56] References Cited

U.S. PATENT DOCUMENTS

| | | | |
|---|---|---|---|
| 3,398,521 | 8/1968 | Bell et al. | 57/299 X |
| 3,511,041 | 5/1970 | Korikovsky et al. | 57/305 X |
| 3,905,184 | 9/1975 | Takai et al. | 57/274 |
| 4,036,001 | 7/1977 | Tamai et al. | 57/274 |
| 4,181,228 | 1/1980 | Hashimoto et al. | 57/276 X |
| 4,435,952 | 3/1984 | Stahlecker et al. | 57/304 X |
| 4,463,909 | 8/1984 | Kiriake et al. | 242/35.5 A |
| 4,472,931 | 9/1984 | Stahlecker | 57/304 X |
| 4,571,931 | 2/1986 | Kupper | 57/276 X |

*Primary Examiner*—John Petrakes

*Attorney, Agent, or Firm*—Barnes, Kisselle, Raisch, Choate, Whittemore & Hulbert

[57] ABSTRACT

A doffing method in a spinning frame or the like comprises steps of holding a spinning bobbin after completion of winding with a holding member, removing the spinning bobbin from a spindle without bunch winds, fitting the spinning bobbin onto a bobbin conveying medium having an air path, cutting the yarn and sucking air within the spinning bobbin through the air path of the bobbin conveying medium to attract an end of the yarn adjacent the spinning bobbin into the spinning bobbin under the guidance of the holding member.

10 Claims, 4 Drawing Figures

METHOD AND APPARATUS FOR DOFFING IN A SPINNING FRAME

FIELD OF THE INVENTION AND RELATED ART STATEMENT

The present invention relates to a doffing method in a spinning frame or the like and an apparatus for carrying out the method.

Conventionally, a spinning bobbin produced on a spinning frame is subsequently conducted to what is called a bunch winding operation to wind an end of a yarn of the spinning bobbin in two or three turns around an upper or lower end of the bobbin in the spinning frame in order to prevent the yarn from being loose from the bobbin during transportation thereof. Accordingly, before the bobbin is supplied to a winding unit, an operation for releasing such bunch winds, that is, what is called a yarn end finding operation, must be absolutely required in order to facilitate automatic joining of yarn ends on the winding unit. This leads to a drawback that the operating efficiency is low and since a yarn end finding device is required, the cost is raised accordingly.

OBJECT AND SUMMARY OF THE INVENTION

It is an object of the present invention to provide a doffing method which does not involve bunch winding and yarn end finding operation therein and to provide a apparatus for carrying out the method.

The doffing method of the present invention comprises the steps of holding a spinning bobbin after completion of winding with a holding cylinder having a yarn passing slit formed therein and removing the spinning bobbin from a spindle without bunch winds and without cutting a yarn, fitting the spinning bobbin onto a bobbin holding peg having an air path to a bobbin transporting device therein, cutting the yarn extending through a traveller to the spinning bobbin and at the same time fixing an end of the yarn adjacent the traveller to a predetermined position so as not to be let off the traveller, and sucking air within the spinning bobbin to attract an end of the yarn adjacent the spinning bobbin into the spinning bobbin under the guidance of the holding cylinder.

BRIEF DESCRIPTION OF THE DRAWING

The drawing shows an example of an apparatus which is used for putting the present invention into practice.

DETAILED DESCRIPTION OF PREFERRED EMBODIMENTS

Figure 1:
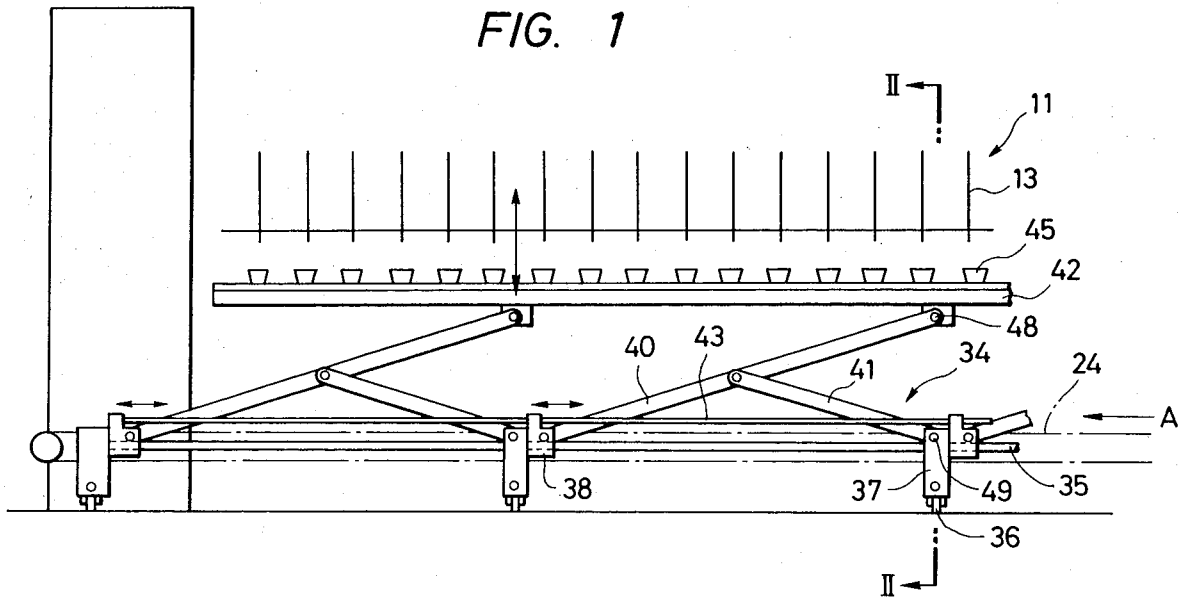
FIG. 1 is a front elevational schematic view of essential part, FIG. 2 an enlarged cross sectional view taken along line II—II of FIG. 1, FIG. 3 an enlarged cross sectional view taken along line III—III of FIG. 2, and FIG. 4 a cross sectional view taken along line IV—IV of FIG. 2.

Now, an embodiment of the present invention will be described with reference to the drawing.

At first, description will be given of an apparatus which is used for putting a method of the embodiment into practice.

Figure 4:
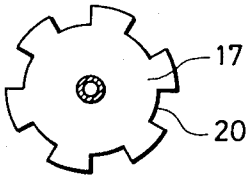
Figure 2:
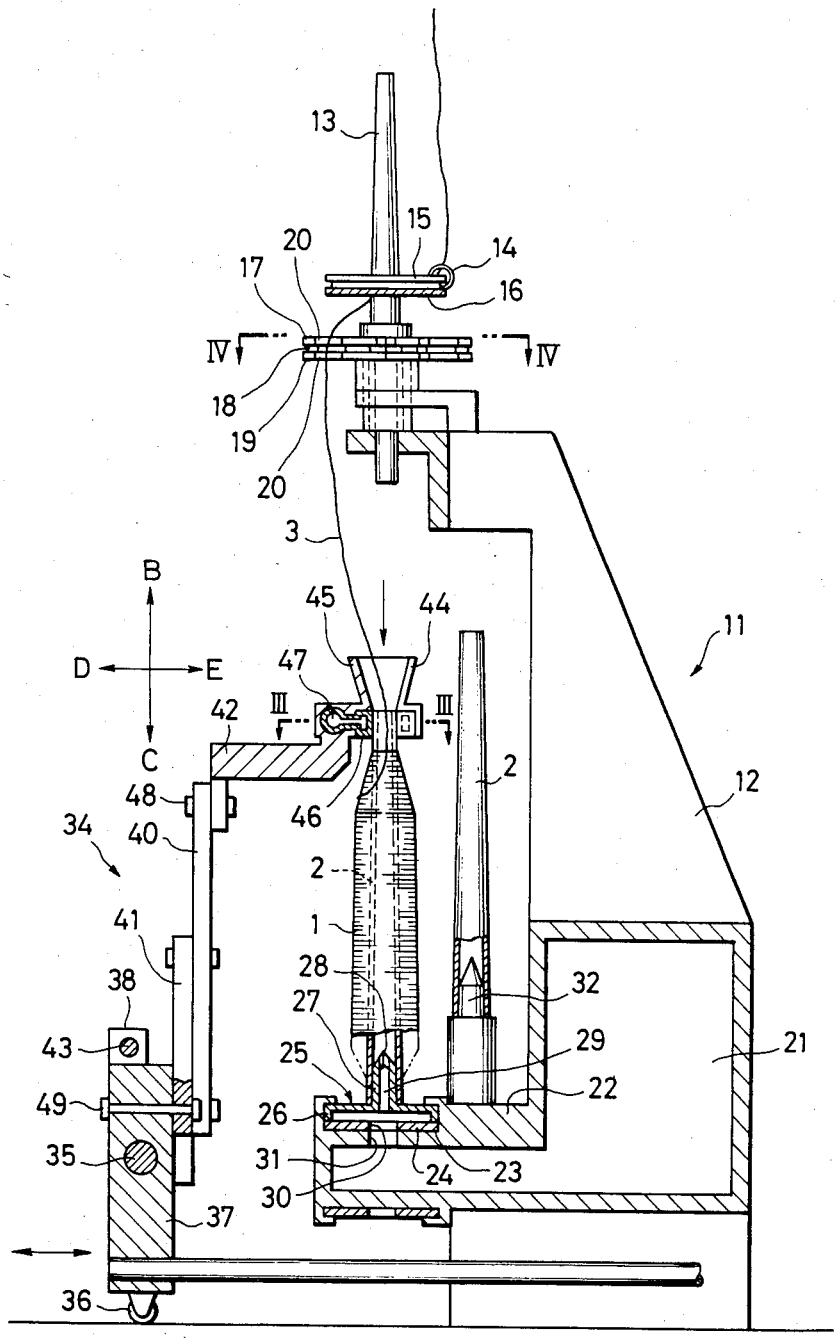

As clearly shown in FIG. 2, a large number of spindles 13 are uprightly mounted for rotation on an upper part of a body 12 of a spinning frame 11. A ring rail 15 having a traveller 14 is fitted around each of the spindles 13, and the ring rails 15 are securely mounted on a rail support 16 mounted for up and down movement. Mounted in a coaxial relationship with each of the spindles 13 on the upper part of the body 12 are a fixed yarn holding disk 17, a rotary cutter 18 which underlies and cooperates with the fixed yarn holding disk 17 to hold a yarn 3 therebetween, and a fixed cutter 18 which underlies and cooperates with the rotary cutter 18 to cut the yarn 3. The fixed yarn holding disk 17, the rotary cutter 18 and the fixed cutter 19 each have a plurality of notches 20 formed in a predetermined angularly spaced relationship for receiving a yarn 3 therein as seen in FIG. 4. A trailing one of radially extending edges of each notch 20 of the rotary cutter 18 in a direction of rotation thereof is formed as a blade while a leading one of edges of each notch 20 of the fixed cutter 19 which cooperates with a blade of the rotary cutter 18 to hold a yarn in the notch 20 therebetween is formed as a blade. By this construction, if the rotary cutter 18 is rotated after a yarn 3 has been introduced into a notch 20, the yarn 3 will be cut by cooperation of the rotary cutter 18 with the fixed cutter 19, and an upper end of the thus cut yarn 3 will be pinched between the fixed yarn holding disk 17 and the rotary cutter 18 while a lower end of the yarn 3 will become free.

A suction duct 21 is provided at a lower part of the body 12 of the spinning frame 11 and extends along a row of the spindles 13. A sucking machine not shown is connected to the suction duct 21. The suction duct 21 has a projecting table 22 formed thereon, and the projecting table 22 has a groove 23 formed to extend in parallel to the row of the spindles 13 therein. A conveyor 24 is fitted in the groove 23 and is arranged to transport a bobbin carrying tray 25, for example, in a direction shown by an arrow A. The tray 25 has a base 26 in the form of a disk, and a peg 27 formed to project from the center of the base 26. An air hole 28 is formed at an upper portion of the peg 27 and communicates with an air path 29 inside the tray 25. The conveyor 24 has a plurality of air holes 30 formed therein in a spaced relationship from each other by a distance equal to the distance between adjacent spindles 13. The conveyor 24 further has a plurality of tray receiving recesses (not shown) formed therein so that when a tray 25 is placed on the conveyor 24, it may be positioned with the center of an air hole 30 aligned with the center of the tray 25. A plurality of air holes 31 are formed in the bottom of the groove 23 of the table 22 and each have an axis which is aligned with a lower extension line of the axis of a spindle 13. By this construction, if the conveyor 24 is stopped at a position in which the air holes 30 therein are aligned with the air holes 31 in the bottom of the groove 23 of the table 22, air within a bobbin 2 fitted on the peg 27 of a tray 25 on the conveyor 24 can be sucked into the suction duct 21 by way of the air hole 28, air path 29, and air holes 30 and 31. The stand 22 has a plurality of pegs 32 located just behind the air holes 31 and extending upwardly for receiving empty bobbins 2 thereon.

Figure 3:
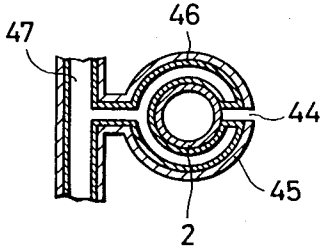

As shown in FIG. 1, a doffing mechanism 34 is located in front of the spinning frame 11. The doffing mechanism 34 has a guide shaft 35 on which a plurality of support blocks 37 each having a wheel 36 at a lower end thereof are securely mounted in a predetermined spaced relationship from each other. The support blocks 37 are moved back and forth, that is, in directions of an arrow D and an arrow E, by a hydraulic cylinder or the like (not shown). The guide shaft 35 further has a plurality of slide blocks 38 mounted in a paired relationship with the support blocks 37 thereon. A longer link 40 is mounted at a lower end thereof for pivotal motion on each of the slide blocks 38, and a shorter link 41 having a length one half to that of the link 40 is mcunted at an end thereof for pivotal motion at the center of the length of the link 40 and has the opposite lower end thereof mounted for pivotal motion on one of the support blocks 37 which is paired with the slide block 38. The longer links 40 are connected at upper ends thereof to a liftable member 42. It is to be noted that a pivotally connecting point 48 between each longer link 40 and the liftable member 42 and a pivotally connecting point 49 of the corresponding shorter link 41 and its associated support block 37 are positioned in a same imaginary vertical plane. The slide blocks 38 are interconnected by means of an operating bar 43 which is moved in the leftward and rightward directions to move the slide blocks 38 in an integral relationship. By moving the slide blocks 38 in the leftward and rightward directions as shown in FIG. 1 in this manner, the liftable member 42 can be moved up and down. As apparent from the foregoing description, the liftable member 42 can freely move in the upward and downward directions (in directions of an arrow B and an arrow C) and in the frontward and backward directions (in directions of the arrow D and arrow E). The liftable member 42 has a plurality of bobbin holding cylinders 45 formed thereon in a paired relationship with the spindles 13. Each of the bobbin holding cylinders 45 has a yarn passing slit 44 formed therein (refer to FIG. 3) and has an elastic air bag 46 provided in a lower part thereof. An air supply pipe 47 is connected to the elastic air bags 46 so that compressed air may be introduced into the elastic air bags 46 from the air supply pipe 47 to inflate them to hold or grip bobbins 2 fitted in the bobbin holding cylinders 45. An upper portion of each bobbin holding cylinder 45 is tapered to open upwardly. It is to be noted, however, that the tapered cylindrical portion of each bobbin holding cylinder 45 may be replaced by a mere cylindrical portion formed on the holding cylinder 45.

An operation of the device as described above, that is, the embodiment of the invention, will be described below.

At first, empty bobbins 2 each uprightly carried on a tray 25 are supplied one by one to the spindles 13 by the conveyor 24 as the conveyor 24 is stopped when the empty bobbins 2 come to respective positions below the spindles 13. Then the liftable member 42 is lowered to put the holding cylinders 45 on the empty bobbins 2, and the elastic air bags 46 are inflated to grip the empty bobbins 2 therein. After then, the empty bobbins 2 are pulled off the pegs 27 of the trays 25 and are moved in the direction of the arrow E and fitted on the pegs 32. After the trays 25 have been emptied in this manner, the empty bobbins 2 are separated, and the holding cylinders 45 positioned above the bobbins 2 are moved first in the direction of the arrow D, then in the direction of arrow B and then in the direction of arrow E, and finally in the direction of the arrow C so that they are put on upper ends of spinning bobbins 1 produced without bunch winds thereon and fitted on the spindle 13 whereafter the elastic air bags 46 are inflated to grip the spinning bobbins 1 therein. It is to be noted that yarns 3 are not cut in this stage. Accordingly, it is necessary to introduce the yarns 3 into the holding cylinders 45 through the yarn passing slits 44 formed in the holding cylinders 45. Then, the spinning bobbins 1 held in the holding cylinders 45 are drawn out from the spindle 13 and fitted uprightly on the pegs 27 of the trays 25 supported on the conveyor 24 by operations reverse to those as described above. By such operations, the yarns 3 which extend to the spinning bobbins 1 through the travellers 14 will be put into recesses 20 of the rotary cutters 18 and so on. Thus, the rotary cutters 18 are operated for a short period of time to cut the yarns 3, and ends of the yarns 3 adjacent the travellers 14 are thus pinched between the rotary cutters 18 and the associated fixed yarn pinching disks 17 while at the same time the sucking machine (not shown) is operated to such air within the spinning bobbins 1 through the air holes 28, 29, 30 and 31 to attract the opposite ends of the yarns 3 adjacent the spinning bobbins 1 into the spinning bobbins 1 under the guidance of the holding cylinders 45. After then, the elastic air bags 46 are deflated to release the spinning bobbins 1 from the holding cylinders and the holding cylinders 45 are lifted. After the conveyor 24 which carrys the trays 25 with the spinning bobbins 1 is moved a little distance to a position in which it will not disturb holding of empty bobbins 2, the empty bobbins 2 placed on the table 22 are held by the holding cylinders 45 and the holding cylinders 45 are moved by the doffing mechanism 34 to fit the empty bobbins 2 on the spindles 13. After the empty bobbins 2 have come to a position clear of the spinning bobbins 1, the conveyor 24 is moved to transport the spinning bobbins 1 to a winding unit for a subsequent next step, and at the same time the empty bobbins 2 are supplied again in the same manner as described above.

As apparent from the foregoing description, according to the present invention, air within a spinning bobbin is sucked to attract an end of a yarn adjacent a spinning bobbin into the spinning bobbin under the guidance of a holding cylinder, and thus bunch winding is not involved as different from prior art methods. Accordingly, workability is improved as far as a yarn end finding operation is not necessitated, and the cost can be reduced as far as a yarn end finding device is not necessitated. Besides, since an end of a yarn is attracted into a spinning bobbin under the guidance of a holding cylinder, this operation can be effected assuredly. In addition, although an end of a yarn is only put in a spinning bobbin, since a spinning bobbin is transported toward a winding unit while it is held uprightly fitted on a peg, the yarn end will not be let off the spinning bobbin at all.

What is claimed is:

1. A doffing method in a spinning frame, characterized in that it comprises steps of holding a spinning bobbin after completion of winding with a holding member, removing the spinning bobbin from a spindle without bunch winds without cutting a yarn, fitting the spinning bobbin onto a bobbin conveying medium, cutting the yarn extending between the spindle and the spinning bobbin, and sucking air within the spinning bobbin to attract an end of the cut yarn adjacent the spinning bobbin into the spinning bobbin carried on the conveying medium.

2. A doffing method in a spinning frame or the like, characterized in that it comprises the steps of holding a spinning bobbin after completion of winding with a holding member having a yarn passing slit formed therein and removing the spinning bobbin from a spindle without bunch winds and without cutting a yarn, fitting the spinning bobbin onto a bobbin conveying medium having an air path therein, cutting the yarn extending through a traveller to the spinning bobbin and at the same time fixing an end of the yarn adjacent the traveller to a predetermined position so as not to be let off the traveller, and sucking air within the spinning bobbin through the air path of the bobbin conveying medium to attract an end of the yarn adjacent the spinning bobbin into the spinning bobbin under the guidance of the holding member.

3. The doffing method as claimed in claim 2, wherein said method further includes a step of feeding an empty bobbin onto the spindle by means of the holding member to hold an empty bobbin which is erected on the conveying medium and transported, and to fit the empty bobbin on the spindle.

4. A doffing apparatus in a spinning frame including a spindle mounted on a spinning body of the spinning frame and a conveyor for transporting a conveying medium on which a spinning bobbin and an empty bobbin are erected and carried, characterized in that it comprises a cutter device mounted in a coaxial relationship with the spindle, a bobbin holding member including a yarn passing slit formed therein, said bobbin holding member being able to hold a spinning bobbin or an empty bobbin and to be moved holding them, a doffing mechanism for moving the bobbin holding member to transfer the spinning bobbin or the empty bobbin between the spindle and the conveying medium, and a sucking means for sucking a yarn end cut by the cutter device to insert the yarn end into the spinning bobbin.

5. The doffing apparatus as claimed in claim 4, wherein said cutter device comprises a fixed yarn holding disk, a rotary cutter which underlies and cooperates with the fixed yarn holding disk to hold a yarn therebetween, and a fixed cutter which underlies and cooperates with the rotary cutter to cut the yarn, said fixed yarn holding disk, said rotary cutter and said fixed cutter each having a plurality of notches formed on the periphery thereof for receiving a yarn therein.

6. The doffing apparatus as claimed in claim 4, wherein said bobbin holding member further includes a cylindrical portion to guide a yarn, an elastic air bag povided in a lower part thereof and an air supply pipe connected to the elastic air bag so that the elastic air bag is inflated by the compressed air supplied from the air supply pipe to hold a bobbin fitted in the bobbin holding member.

7. The doffing apparatus as claimed in claim 6, wherein said cylindrical portion of the bobbin holding member is tapered to open upwardly.

8. The doffing apparatus as claimed in claim 4, wherein said conveying medium is a tray having a base in the form of a disk and a peg formed to project from the center of the base and having a first air hole formed at an upper portion thereof, and the conveyor has a second hole formed therein so that the second air hole may be aligned with the center of the tray when the tray is placed on the conveyor.

9. The doffing apparatus as claimed in claim 8, wherein the suction means comprises a suction duct, a projecting table formed on the suction duct and having a groove formed to extend in parallel to the row of the spindle, in said groove the conveyor being fitted, and a third air hole formed in the groove of the table and aligned with the second hole of the conveyor so that air within the bobbin fitted on the peg of the tray on the conveyor can be sucked into the suction duct by way of the first, second and third air holes.

10. The doffing apparatus as claimed in claim 9, wherein said projecting table has a peg located just behind the third air hole and extending upwardly for receiving an empty bobbin thereon.

* * * * *